US008904931B2

(12) United States Patent
Flint et al.

(10) Patent No.: US 8,904,931 B2
(45) Date of Patent: Dec. 9, 2014

(54) PRINTING BLANKET CONSTRUCTION AND METHOD OF MAKING

(75) Inventors: W. Toriran Flint, Asheville, NC (US); Richard Czerner, Weaverville, NC (US)

(73) Assignee: Day International, Inc., Dayton, OH (US)

( * ) Notice: Subject to any disclaimer, the term of this patent is extended or adjusted under 35 U.S.C. 154(b) by 1203 days.

(21) Appl. No.: 10/986,491

(22) Filed: Nov. 10, 2004

(65) Prior Publication Data

US 2005/0098051 A1 May 12, 2005

Related U.S. Application Data

(60) Provisional application No. 60/518,783, filed on Nov. 10, 2003.

(51) Int. Cl.
*B41B 1/02* (2006.01)
*B41N 10/04* (2006.01)

(52) U.S. Cl.
CPC ..... *B41N 10/04* (2013.01)
USPC ..... 101/401; 101/376; 101/401.1

(58) Field of Classification Search
USPC ..... 101/415.1, 375, 376, 401.1
See application file for complete search history.

(56) References Cited

U.S. PATENT DOCUMENTS 3,960,077 A 6/1976 Aylett
4,635,550 A 1/1987 Brands et al.
5,103,729 A * 4/1992 Philpot ..... 101/415.1
5,327,831 A 7/1994 Depa et al.
5,357,863 A * 10/1994 McLean et al. ..... 101/389.1
5,546,858 A * 8/1996 Stephan ..... 101/142
5,669,306 A 9/1997 Puschnerat
5,687,648 A 11/1997 Puschnerat et al.
5,692,443 A * 12/1997 Reutter ..... 101/415.1
5,732,630 A * 3/1998 Puschnerat et al. ..... 101/415.1
5,749,298 A * 5/1998 Castelli et al. ..... 101/415.1
5,809,890 A * 9/1998 Knauer et al. ..... 101/415.1
5,934,194 A * 8/1999 Puschnerat et al. ..... 101/375
6,101,942 A * 8/2000 Robert ..... 101/415.1
6,530,321 B2 * 3/2003 Andrew et al. ..... 101/376

(Continued)

FOREIGN PATENT DOCUMENTS

DE 3315506 A1 10/1984
DE 4400020 A1 8/1995

(Continued)

OTHER PUBLICATIONS

Third Party Observation dated Apr. 1, 2009.

(Continued)

*Primary Examiner* — Matthew G Marini
(74) *Attorney, Agent, or Firm* — Dinsmore & Shohl LLP

(57) ABSTRACT

An improved printing blanket construction is provided which includes at least a top ply, a bottom ply, and a non-extensible backing ply. The blanket includes leading and trailing edges which are secured directly to the backing ply, where at least a portion of the leading edge forms a contoured edge, a stair-stepped edge, a beveled edge, or a combination thereof. The printing blanket construction having such a shaped leading edge reduces printing gap, reduces the impact forces on the leading edge of the blanket, and protects the blanket from the penetration of ink, solvents, moisture and the like into the blanket plies during use.

5 Claims, 2 Drawing Sheets

(56) References Cited

U.S. PATENT DOCUMENTS

| | | | | |
|---|---|---|---|---|
| 6,645,601 | B1 * | 11/2003 | Serain et al. | 428/121 |
| 6,748,861 | B1 * | 6/2004 | Riepenhoff et al. | 101/375 |
| 2002/0025422 | A1 | 2/2002 | Fullgraf et al. | |
| 2003/0150346 | A1 | 8/2003 | Haraux et al. | |
| 2003/0213390 | A1 | 11/2003 | Malkic | |

FOREIGN PATENT DOCUMENTS

| | | | |
|---|---|---|---|
| DE | 20007227 | U1 | 4/2000 |
| DE | 10222225 | A1 | 12/2003 |
| EP | 0182156 | A2 | 5/1986 |
| EP | 1 072 434 | A | 1/2001 |
| JP | 7195861 | A | 8/1995 |
| JP | 8323954 | A | 12/1996 |
| JP | 2001310571 | A | 11/2001 |
| JP | 2002059671 | A | 2/2002 |
| JP | 2003165283 | A | 6/2003 |
| WO | WO 01/28775 | A | 4/2001 |
| WO | WO 2004/054808 | | 7/2004 |

OTHER PUBLICATIONS

Japanese Official Action dated Oct. 9, 2009 pertaining to Japanese Application No. 2006-539775.

* cited by examiner

PRINTING BLANKET CONSTRUCTION AND METHOD OF MAKING

CROSS REFERENCE TO RELATED APPLICATIONS

This application claims the benefit of U.S. Provisional Application No. 60/518,783 filed Nov. 10, 2003.

BACKGROUND OF THE INVENTION

The present invention relates in general to a printing blanket construction, and more particularly, to an improved printing blanket which reduces printing gap, which reduces the impact forces on the leading edge of the blanket, and which prevents the penetration of ink, solvents, moisture and the like into the blanket plies during use.

One of the most common commercial printing processes is offset lithography. Non-tensioned offset printing blankets are typically made on a thin, low elongation carrier, or backing, having ends that extend beyond the end of the actual printing blanket. The ends are bent or otherwise formed so that they can be inserted into a narrow-gap printing press cylinder lock-up to hold the blanket in place.

However, this type of narrow-gap lock-up system results in the leading and trailing end edges of the blanket being exposed rather than tucked inside the lock-up or cylinder. This exposure subjects the blanket ends to mechanical impact forces and the penetration of water, inks and chemicals used during the printing process, which can result in swelling and delamination of the blanket layers. Such conditions may contribute to premature blanket failure.

A common method of avoiding this problem is to apply a sealant to the end edges of the blanket to prevent moisture from penetrating the layers. See, for example, Castelli et al., U.S. Pat. No. 5,749,298. However, as the blanket comprises a composite of dissimilar materials, many sealants do not adhere well to the dissimilar materials at the blanket edges, particularly due to the minimal surface area of the edges to which the sealant is adhered.

As an alternative to the use of sealants, attempts have been made to reduce the gap between the blanket ends when the blanket is attached to the cylinder. See, for example, U.S. Pat. No. 4,635,559, which teaches a blanket including a filler portion which is fixed to the end of the blanket and spans the gap between the leading and trailing edges. See also U.S. Pat. No. 5,732,630, which teaches a rubber blanket having leading and trailing edges including closures which interlock to form a seamless blanket when the blanket is placed on a blanket cylinder. However, such blanket constructions require the use of additional elements or filler materials which add to the cost of producing the blanket.

Accordingly, there is still a need in the art for an improved method of reducing printing gap and effectively protecting the leading edge of the blanket from impact forces and the penetration of moisture into the layers of the blanket construction.

SUMMARY OF THE INVENTION

The present invention meets that need by providing an improved printing blanket construction in which the leading edge of the printing blanket is shaped so as to provide reduced gap between the leading and trailing edges when the blanket is installed on a press. The leading edge may be shaped to a degree which eliminates the need for an edge seal, or alternatively, the leading edge may be shaped so as to increase the surface area to which a sealant may be effectively applied. The resulting blanket is effectively protected against exposure to impact forces as well as protected against the penetration of inks, solvents, and moisture.

According to one aspect of the present invention, a printing blanket construction is provided comprising a printing blanket which comprises at least a top ply, a bottom ply and a non-extensible backing ply. Preferably, the printing blanket further comprises an intermediate ply. The printing blanket has leading and trailing edges which are secured directly to the backing ply, wherein at least a portion of the leading edge forms a contoured edge, a stair-stepped edge, a beveled edge, or a combination thereof. Preferably, the printing blanket has a printing gap of less than about 3.5 mm, and more preferably, less than about 2.5 mm.

In one embodiment of the invention, the printing blanket preferably has a contoured leading edge. Preferably, the contoured leading edge is formed only from the top ply of the blanket. In an alternative embodiment, the contoured leading edge may be formed from the top, intermediate and/or bottom plies. Preferably, the angle formed by the contoured leading edge is from about 10 to 70 degrees from horizontal and the distance between the contoured leading edge and the beginning of the contour is from about 0.05 mm to about 0.95 mm. More preferably, the angle formed by the contoured leading edge is from about 15 to about 45 degrees from horizontal and the distance between the contoured leading edge and the beginning of the contour is from about 0.20 mm to about 0.80 mm. In this embodiment of the invention, at least a portion of the trailing edge of the blanket is preferably undercut. Also in this embodiment, the leading and trailing edges of the blanket are preferably free of sealants.

In an alternative embodiment of the invention, the leading edge forms a stair-stepped edge, a beveled edge, or a combination stair-stepped and beveled edge. Preferably, the portion of the leading edge which forms the stair-stepped edge, beveled edge, or combination thereof includes the top and bottom plies of the blanket. More preferably, the printing blanket further comprises an intermediate ply, where the portion of the leading edge which forms the stair-stepped edge, beveled edge, or combination thereof includes the top ply, intermediate ply, and bottom ply.

In yet another alternative embodiment of the invention, a sealant is included on at least one of the leading or trailing edges of the printing blanket. In this embodiment, the leading edge of the printing blanket is preferably formed to have a beveled leading edge, a stair-stepped leading edge, or a combination beveled and stair-stepped leading edge.

Preferably, the portion of the leading edge which forms the stair-stepped edge, beveled edge, or combination thereof includes the top and bottom plies of the blanket. Preferably, the printing blanket further comprises an intermediate ply, where the portion of the leading edge which forms the stair-stepped edge, beveled edge, or combination thereof includes the top ply, intermediate ply, and bottom ply. Thus, the sealant is included on at least one of the leading and trailing edges of the blanket such that it effectively seals all the plies of the blanket and the interface between the blanket and the backing ply.

The present invention also provides a method of making the printing blanket construction. In one embodiment, the method comprises providing a printing blanket having leading and trailing edges and comprising at least a top ply and a bottom ply, adhering at least the leading and trailing edges of the printing blanket directly to a non-extensible backing ply, and removing at least a portion of the leading edge to form a contoured edge, a stair-stepped edge, a beveled edge, or a combination thereof. Preferably, the portion of the leading edge is removed by grinding, cutting, skiving, burning, water jetting, or laser ablading. The preferred method of removing a portion of the printing surface is by grinding with a rotary wheel.

The portion of the leading edge is preferably removed after adhering the leading and trailing edges to the backing ply. In an alternative embodiment, the portion of the leading edge may be removed before adhering the leading and trailing edges to the backing ply.

In one embodiment of the method, the portion of the leading edge is removed such that the blanket has a contoured leading edge. In this embodiment, the portion of the leading edge is removed by removing a portion of the top ply. Preferably, the method further includes undercutting the trailing edge of the blanket.

In another embodiment of the invention, the portion of the leading edge is removed such that the blanket has a beveled leading edge, a stair-stepped leading edge, or a combination beveled and stair-stepped leading edge. In this embodiment, the portion of the leading edge comprises removing a portion of the top ply and bottom ply. Alternatively, the printing blanket may further comprise an intermediate ply, where removing at least a portion of the leading edge comprises removing a portion of the top ply, intermediate ply, and bottom ply. In this embodiment, the method preferably includes applying a sealant to the leading edge of the blanket.

In an alternative method of making the printing blanket construction, at least a portion of the leading edge is molded to form a contoured edge, a stair-stepped edge, a beveled edge, or a combination thereof (without removing a portion of the leading edge). In one embodiment, only the top ply of the blanket is molded. In an alternative embodiment, the top and bottom ply of the blanket are molded.

By removing a portion of the leading edge of the blanket or molding the leading edge to have a desired shape, the gap between the leading and trailing edges is reduced, which is believed to reduce the shock effect (impact forces) which typically occurs with the use of conventional blankets when the blanket ends come into compressive interference at the nip between the blanket and print cylinders.

In embodiments where an optional sealant is adhered to at least one of the leading and trailing edges, modifying the leading edge increases the surface area of the leading edge such that the sealant adheres more readily to the blanket edge. The sealant provides effective protection and does not peel or split. Thus, the sealant effectively seals the leading and/or trailing end edges of the blanket against exposure to impact forces as well as ink, solvents, and moisture. The beveled configurations of the blanket and sealant also function to reduce the build-up of ink and lint in the gap that would normally occur during printing and reduces the impact forces on the ends of the blanket.

Accordingly, it is a feature of the present invention to provide a printing blanket construction and method that effectively reduces the printing gap and effectively protects at least the leading edge of the blanket from impact forces and the penetration of moisture into the layers of the blanket construction. Other features and advantages of the invention will be apparent from the following description and the accompanying drawings.

DETAILED DESCRIPTION OF THE PREFERRED EMBODIMENTS

Figure 1:
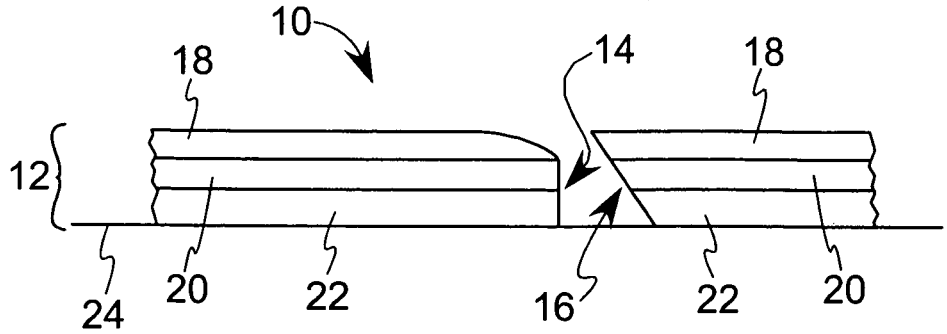
FIG. 1 is a cross-sectional view of a printing blanket construction having a contoured leading edge according to one embodiment of the present invention.

FIG. 1 illustrates one embodiment of the printing blanket construction of the present invention. The printing blanket construction 10 includes a printing blanket 12 having leading and trailing edges, 14 and 16, respectively. By "leading edge," we mean that edge of the blanket which, when mounted on a rotating blanket cylinder, is the edge that first enters the nip between the blanket cylinder and printing cylinder. By "trailing edge," we mean the edge of the blanket opposite the leading edge.

The blanket preferably includes a top ply 18, an intermediate ply 20, a bottom ply 22, and a non-extensible backing ply 24. The top ply 18 is preferably an inked image accepting surface ply. The intermediate and bottom plies may comprise compressible plies and/or reinforcing plies, depending on the design of the blanket. The leading and trailing edges of the blanket are secured directly to the backing ply as is conventional in the art. The non-extensible backing ply preferably comprises a metal such as stainless steel, but may also comprise other metals such as nickel or aluminum as well as polymers, films, and other nonwoven materials.

It should be appreciated that the blanket may comprise fewer or additional layers. Suitable printing blankets for use in the present invention are described in commonly assigned U.S. Pat. No. 4,770,928 to Gaworowski et al. and U.S. Pat. No. 6,530,321 to Andrew et al., the entire disclosures of which are hereby incorporated by reference.

As shown in FIG. 1, a portion of the leading edge 14 of the blanket forms a contoured edge. In the embodiment shown, the contoured leading edge is formed only from the top ply 18 of the blanket.

Also as shown in FIG. 1, a portion of the trailing edge 16 of the printing blanket is preferably undercut. By undercutting the trailing edge, the overall gap between the leading and trailing edges is reduced. However, it should be appreciated that undercutting the trailing edge is not required for the contoured leading edge to function properly.

Preferably, the printing blanket has a printing gap of less than about 3.5 mm, and more preferably, less than about 2.5 mm. By "printing gap" it is meant the distance between the leading and trailing edges when mounted on a blanket cylinder. In FIG. 1, the leading and trailing edges are preferably free of sealants. In this embodiment, sealants are not needed because there is less gap between the leading and trailing edges of the blanket, and the impact forces on the leading edge of the blanket are is lessened by the contouring.

In the above embodiment, the portions of the leading and/or trailing edges of the blanket are preferably removed by grinding, cutting, skiving, burning, water jetting, or laser ablading. A preferred method of achieving the desired configuration is by grinding. Alternatively, the plies may be molded or cast to form the desired configuration. This may be achieved by placing a mold adjacent the blanket edge and forming or casting material in the mold.

Figure 2:
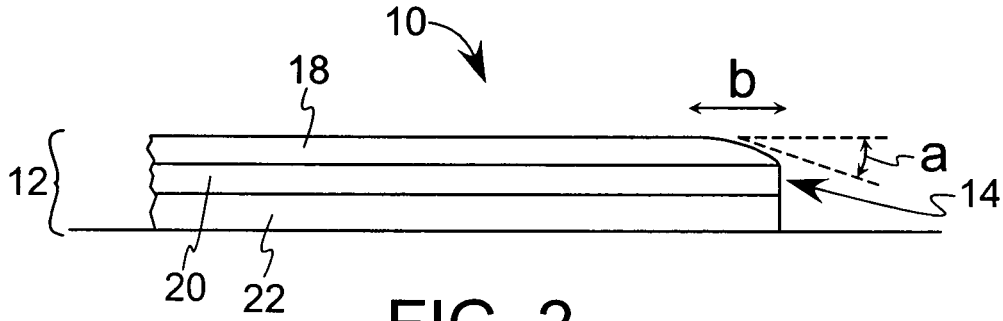
FIG. 2 is a cross-sectional view of the printing blanket construction of FIG. 1 illustrating the angle of the contoured leading edge.

FIG. 2 illustrates the angle formed by the contoured leading edge of the printing blanket. The angle "a" formed by the contoured leading edge is preferably from about 10 to 70 degrees from horizontal and the distance "b" between the contoured leading edge and the beginning of the contour is from about 0.05 mm to about 0.95 mm. More preferably, the angle formed by the contoured leading edge is from about 15 to about 45 degrees from horizontal and the distance between the contoured leading edge and the beginning of the contour is from about 0.20 mm to about 0.80 mm. It should be appreciated that the angle and distance may vary such that the "ramp" formed by the contoured leading edge is shaped such that the leading edge enters the compressed nip between the plate and blanket cylinders smoothly with minimal or no impact.

Figure 3:
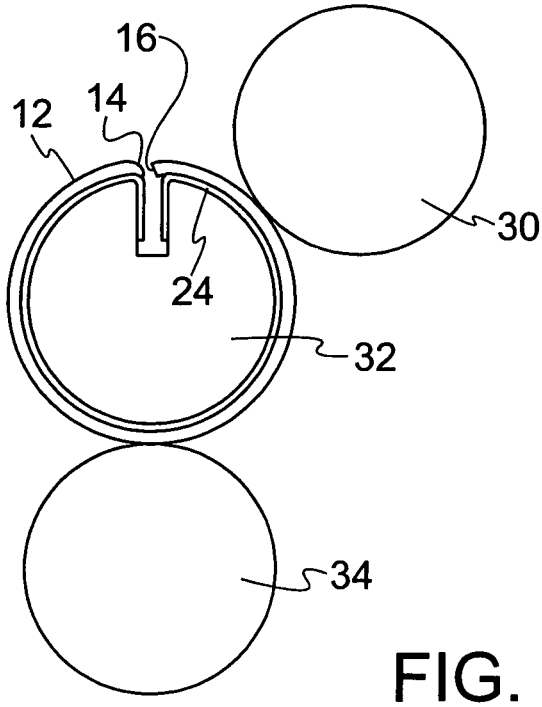
FIG. 3 is a cross-sectional view of the printing blanket construction mounted on a blanket cylinder in an offset printing operation.

FIG. 3 illustrates the arrangement of printing cylinders in an offset printing operation. The cylinders include a plate cylinder 30 which includes a printing plate on its periphery (not shown), a blanket cylinder 32 carrying the printing blanket construction 12 on its periphery, and an impression cylinder 34. In a printing operation, ink is applied to the printing plate of plate cylinder 32 and the image is transferred from the plate cylinder to the blanket cylinder 32. A web (not shown) is passed into a nip formed by the blanket cylinder 32 and impression cylinder 34 and receives the image. In use, the reduced gap between the leading and trailing edges resulting from the contoured leading edge of the blanket results in better print quality, larger print lengths, and less press wear at high speeds. The contoured leading edge also functions to prevent damage to the leading edge from impact between the blanket cylinder and the plate cylinder and between the blanket cylinder and the impression cylinder.

Figure 4:
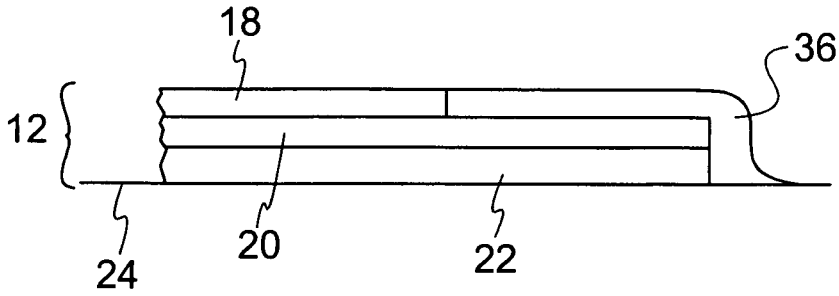
FIG. 4 is a cross-sectional view of a printing blanket construction according to another embodiment of the invention.

An alternative embodiment of the printing blanket construction is illustrated in FIG. 4. In this embodiment of the invention, a portion of the leading edge of the blanket has been removed, and an optional sealant has been applied to the leading edge., In the embodiment shown in FIG. 4, a portion of the top ply 18 has been removed such that the leading edge has a stair-step configuration. A sealant 36 is included in the area of the removed top ply and extends down to the backing ply 24. Thus, the sealant provides a liquid-tight seal to the leading edge of the blanket. The sealant used in the present invention may comprise any conventional sealant that provides chemical and moisture-resistance including, but not limited to, epoxy adhesives, hot melt adhesives, polyurethane adhesives, moisture curable adhesives, UV curable adhesives, heat curable adhesives, cyanoacrylate adhesives, fluorosilicone adhesives, fluoropolymer-based adhesives, and acrylic-based adhesives.

Figure 5:
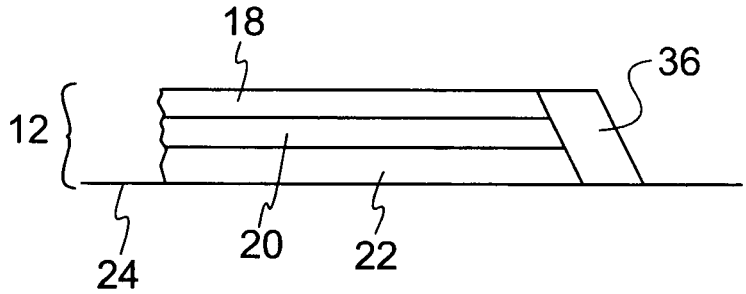
FIG. 5 is a cross-sectional view of a printing blanket construction according to another embodiment of the invention.

FIG. 5 illustrates an alternative embodiment where a portion of the top, intermediate, and bottom plies has been removed to provide a beveled configuration to the leading edge. As shown, the sealant 36 extends from the top ply 18 of the blanket to the backing ply 24.

Figure 6:
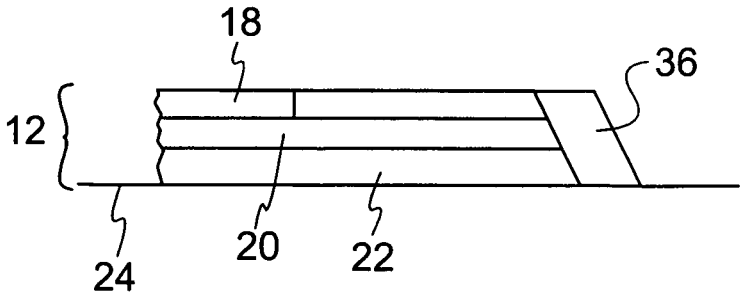
FIG. 6 is a cross-sectional view of a printing blanket construction according to another embodiment of the invention.

FIG. 6 illustrates yet another alternative embodiment in which a portion of the top ply and a portion of the intermediate and bottom plies have been removed to form a combination beveled/stair-stepped configuration.

While the three embodiments shown in FIGS. 4-6 and disclosed herein illustrate preferred configurations for providing increased surface area to the blanket leading edge for the application of sealant, it should be appreciated that other portions of the leading edge may be removed to provide different configurations as long as they effectively increase the surface area of the blanket edge to which the sealant is applied.

In the above embodiments, the portion(s) of the ply or plies of the blanket is/are preferably removed by grinding, cutting, skiving, burning, water jetting, or laser ablading. Alternatively, the plies may be molded or cast to form the desired configuration. In embodiments where more of the upper portion than the lower portion of the leading edge is removed, the preferred method of removal is grinding with a rotary grinding wheel. Preferably, the leading edge of the blanket is ground to a depth is of from about 1.0 to about 7.5 mm, and more preferably from about 2.0 mm to about 5.0 mm.

In embodiments where a beveled edge profile is desired, a single pass with a profiled wheel is preferred. In embodiments where a stair-stepped profile is desired, multiple passes with a flat wheel are preferred. To achieve the preferred combination stair-step and beveled profile, a beveled edge is first achieved using a profiled wheel, followed by grinding with a flat wheel.

After removal of the desired areas of the end edges, the sealant 30 is applied. After the sealant has been applied to the end edges, and cured (if necessary) the blanket may be mounted on a blanket cylinder for use.

What is claimed is:

1. In combination, a printing blanket construction mounted on a blanket cylinder which includes a gap, said printing blanket construction comprising:

a printing blanket comprising at least a top ply, a bottom ply and a non-extensible backing ply; said blanket having leading and trailing edges, said leading and trailing edges including said top and bottom plies; wherein at least a portion of said leading edge of said top ply has been removed or molded to form a curved contoured edge such that the leading edge of said bottom ply extends beyond the beginning of the contour of the leading edge of said top ply; wherein the angle formed by said contoured leading edge is from about 15 to about 45 degrees from horizontal and wherein the distance between said contoured leading edge and the beginning of the contour is from about 0.20 mm to about 0.80 mm.

2. The combination of claim 1 wherein said curved contoured leading edge is formed only from said top ply of said blanket.

3. The combination of claim 1 wherein said curved contoured leading edge is formed from said top and bottom plies of said blanket.

4. The combination of claim 1 further comprising an intermediate ply, wherein said curved contoured leading edge is formed from said top ply, said bottom ply, and said intermediate ply.

5. The combination of claim 1 wherein said leading and trailing edges of said printing blanket have a printing gap of less than 2.5 mm.

* * * * *

UNITED STATES PATENT AND TRADEMARK OFFICE

CERTIFICATE OF CORRECTION

PATENT NO. : 8,904,931 B2
APPLICATION NO. : 10/986491
DATED : December 9, 2014
INVENTOR(S) : W. Toriran Flint et al.

It is certified that error appears in the above-identified patent and that said Letters Patent is hereby corrected as shown below:

IN THE SPECIFICATION

Col. 4, Line 62,
"edge of the blanket are is lessened by the contouring." should read
--edge of the blanket are lessened by the contouring.--; and Col. 6, Line 17,
"ground to a depth is of from about 1.0 to about 7.5 mm, and" should read
--ground to a depth of from about 1.0 to about 7.5 mm, and--.

Signed and Sealed this
Twenty-sixth Day of January, 2016

Michelle K. Lee

Michelle K. Lee
*Director of the United States Patent and Trademark Office*